US005535609A

United States Patent [19]

Kuo

[11] Patent Number: 5,535,609

[45] Date of Patent: Jul. 16, 1996

[54] LOCK HOUSING WITH A KEY WAY BLOCKING MEANS

[76] Inventor: Wen-tai Kuo, No. 16, Lane 459, Sec. 1, An-Ho Rd., Tainan City, Taiwan

[21] Appl. No.: 413,452

[22] Filed: Mar. 30, 1995

[51] Int. Cl.[6] ..... E05B 67/22

[52] U.S. Cl. ..... 70/423; 70/52; 70/39; 70/455

[58] Field of Search ..... 70/38 R, 38 A, 70/38 B, 38 C, 39, 423, 455, 52

[56] References Cited

U.S. PATENT DOCUMENTS

| | | | |
|---|---|---|---|
| 2,169,895 | 8/1939 | Evans | 70/38 C |
| 2,904,985 | 9/1959 | Murphy | 70/455 |
| 4,584,855 | 4/1986 | Burlingame | 70/423 |
| 4,888,967 | 12/1989 | Kuo | 70/54 |
| 4,918,949 | 4/1990 | Newbold | 70/39 |
| 5,010,746 | 4/1991 | Zane et al. | 70/55 |

FOREIGN PATENT DOCUMENTS

| | | | |
|---|---|---|---|
| 388160 | 1/1924 | Germany | 70/38 C |
| 122114 | 6/1948 | Sweden | 70/423 |
| 2246162 | 1/1992 | United Kingdom | 70/423 |

*Primary Examiner*—Barnell M. Boucher
*Attorney, Agent, or Firm*—Morton J. Rosenberg; David I. Klein

[57] ABSTRACT

A lock housing with a key way blocking means for selectively blocking the key way includes a pair of meshing halve lock housings, and a circular ring turnably secured on one of the lock housing. The circular ring includes an aperture at one side which is sized and shaped in correspondance with the key way of the lock housing. When the circular ring is turned to a first direction, the key way of the lock housing is exposed outwardly for insertion of a legal key to unlock the lock. When the circular is turned to a second direction, the aperture of the ring departs away from and blocks the key way.

1 Claim, 5 Drawing Sheets

LOCK HOUSING WITH A KEY WAY BLOCKING MEANS

BACKGROUND OF THE INVENTION

Field of the Invention

This invention relates to a lock housing, and more particularly to a lock housing comprises two mating halve bodies and a circular ring for selectively blocking a key way of the lock.

A variety of locks are widespread used at recent years for the security of personal belongings, such as bicycle, motorcycle, and the like, such as the lock, as shown in FIG. 4, comprises a U-shaped shackle 11 and a cross piece 12 adapted to lock across the ends of the shackle 11. The cross piece 12 has a key way 13 at a center portion on one side for a legal key to insert therein to unlock the lock. This lock has achieved the intented function, successfully. However, it has drawbacks. One of which drawbacks is the key way is exposed outwardly that may cause foreign objects to get into the key way. An other drawbacks is that most prior locks have covered with a plastic material in order to avoid sharp edges which increases the cost of material and manpower.

SUMMARY OF THE INVENTION

It is the primary object of the present invention to provide a lock housing which is formed with two mating halve bodies and a circular ring. The circular ring is able to block the key way of the lock core to prevent foreign objects from getting into the key way.

It is an other object of the present invention to provide a lock housing having a key way blocking means which is easy to operate.

It is a further object of the present invention to provide a lock housing having a key way blocking means which costs less in manufacturing.

DETAILED DESCRIPTION OF THE PREFERRED EMBODIMENT

Figure 1:
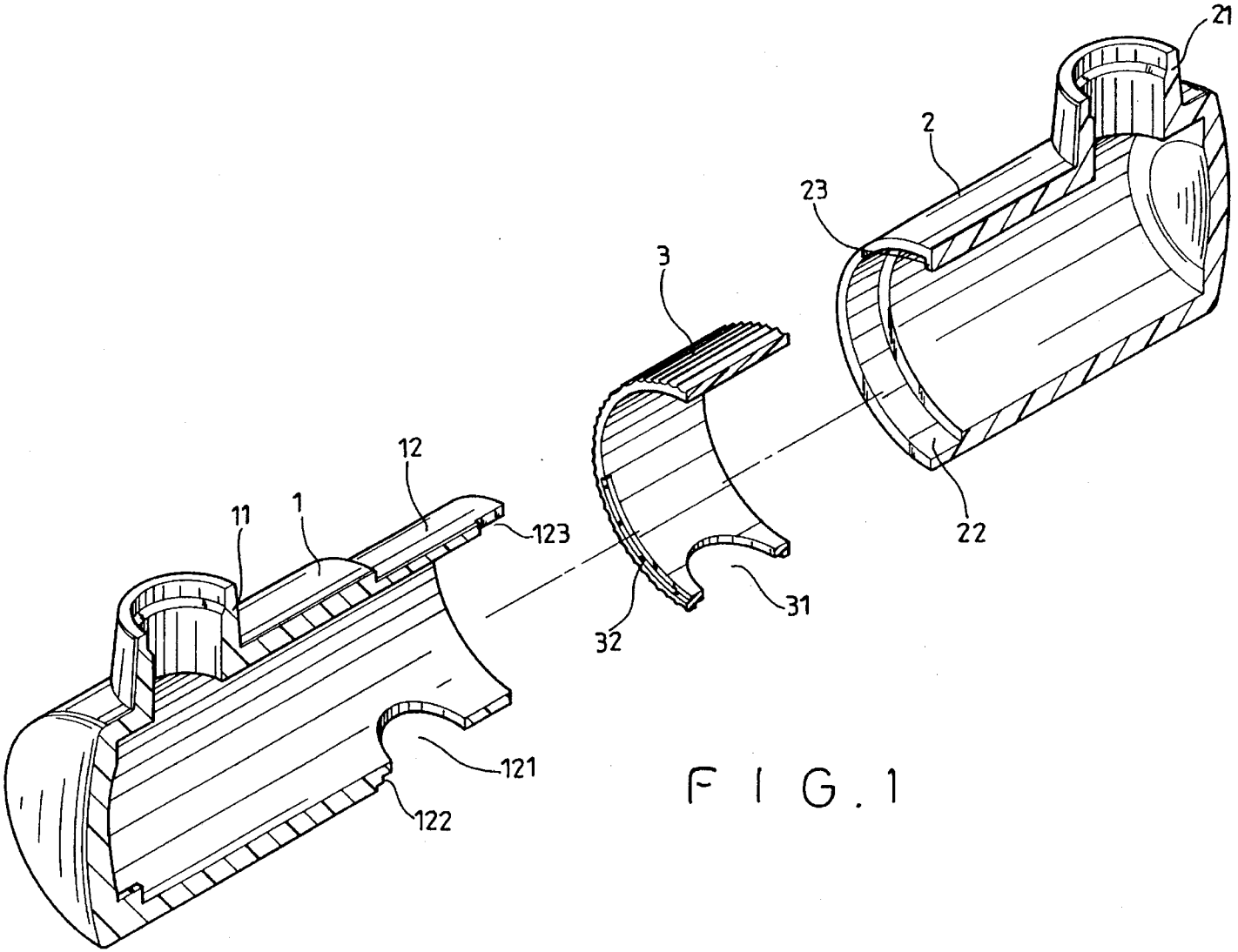
FIG. 1 is an exploded cross-sectional view of the present invention.

Referring now to FIGS. 1 through 3B, wherein the showings are for the purpose of illustrating a preferred embodiment only and not for the purpose of limiting an inventive concept as illustrated therein. FIG. 1 comprises a first lock housing 1, a second lock housing 2, and a circular ring 3 forming the present invention. Both of the first lock housing 1 and the second lock housing 2 are integrally formed with hard yet resilient plastic material.

Figure 2:
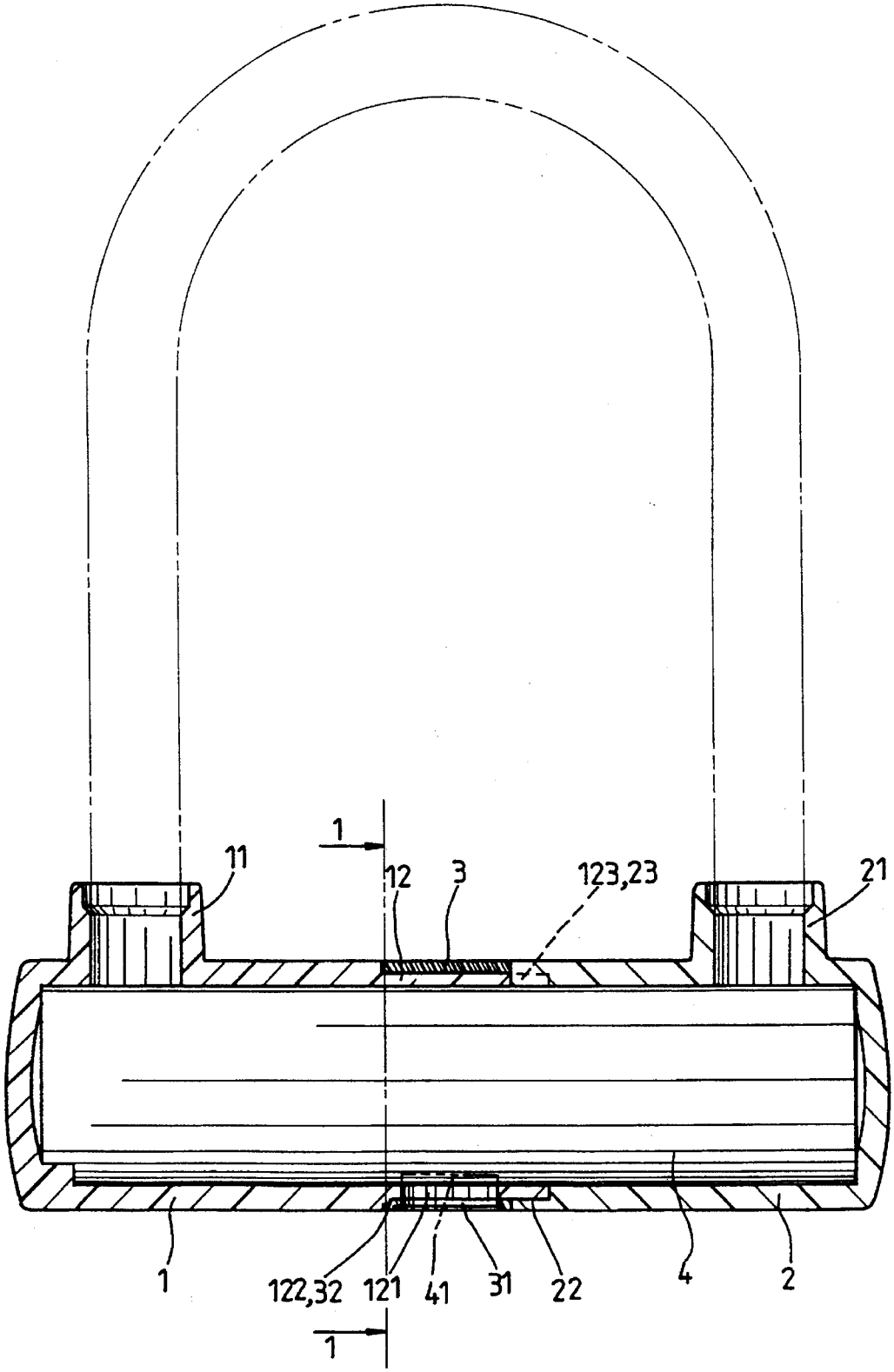
FIG. 2 is a cross-sectional view of the present invention having a lock core secured therein.

The first lock housing 1 has a longitudinal passage along the axis adapted to accommodate partial portion of a lock core therein having a closed end and an opening end at opposite end of the closed end, and comprises a boss 11 extending upwardly and transversely from one side of the lock housing 1 near the closed end, having a central aperture in communication with the passage of the housing 1 adapted to receive an end of a U-shaped shackle, as shown in FIG. 2. A reduced outer diameter portion is formed at the opening end, defining a neck 12 which has an aperture 121 at one side near the opening end, defining a key way thereat, a flange 122 extending from the conjunction area between the housing 1 and the neck 12, and a notch 123 at the opening end.

Ths second lock housing 2 has also a longitudinal passage along the axis adapted to accommodate the remaining portion of the lock core having a closed end, and an opening end at the opposite end of the closed end, and comprises a boss 21 extending upwardly and transversely from one side near the closed end having a central aperture in communication with the passage of the housing 2 adapted to receive the other end of the U-shaped shackle. A circular recess 22 is formed at an inner end of the second lock housing 2. The recess is sized and shaped to be sleeved on the neck 12 therein. A flange 23 is formed at one inner end of the periphery of the recess 22 adapted to mesh the notch 123 of the first lock housing 1 for a close engagement.

The circular ring 3 has an inner diameter slightly larger than the outer diameter of the neck 12 of the first lock housing 1 so as to be sleeved on the neck 12, and comprises an aperture 31 at one side which is identical, both in shape and size, to the key way 121 of the first lock housing 1, and a longitudinal groove 32 which is sized and shaped to receive the protruding portion 122 therein in such a manner that the circular ring 3 is able to rotate on the neck 12 of the first lock housing 1.

To assemble the present invention, the circular ring 3 and the recess 22 of the second lock housing 2 are slid onto the neck 12 of the first lock housing 1 with the flange 122 of the first lock housing 1 received in the groove 32 of the circular ring 3 and the flange 23 of the second lock housing 2 received in the notch 123 of the first lock housing 1, as shown in FIG. 2. The connecting areas betwen the first lock housing 1, the second lock housing 2, and the circular ring 3 are bonded together either by supersonic heat melting method or by preformed glue.

The width of the neck 12 of the first lock housing 1 equals to the widths of the circular recess 22 and the circular ring 3, and therefore, when the lock of the present invention is assembled, the circular ring 3 and the circular recess 22 of the second lock housing 2 will cover the neck 12 of the first lock housing 1.

Figure 3A:
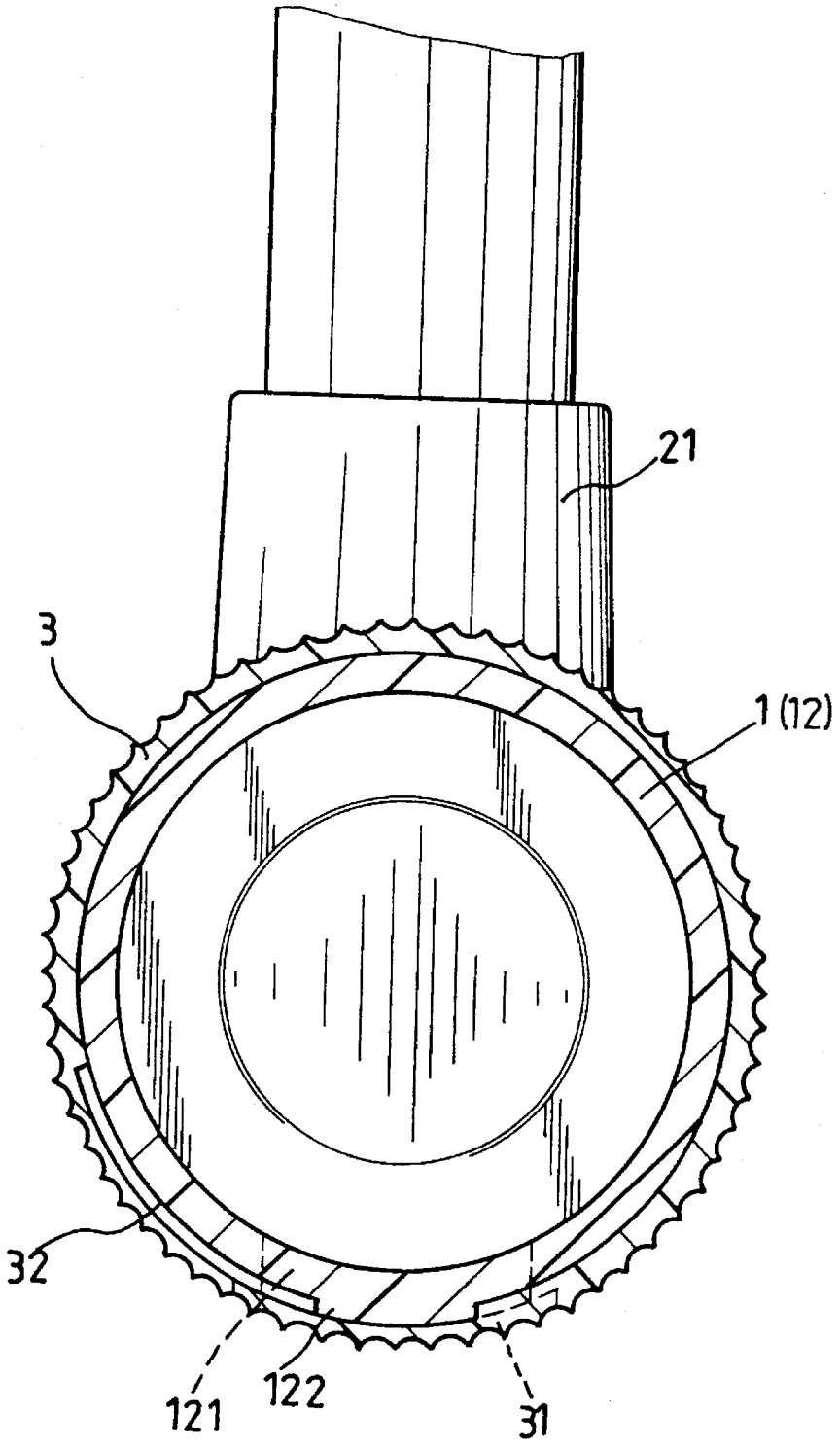
FIG. 3A is a cross-sectional view taken along ling 1—1 of FIG. 2, showing an opening of a circular ring being turned to align with a key way of the lock core.
Figure 3B:
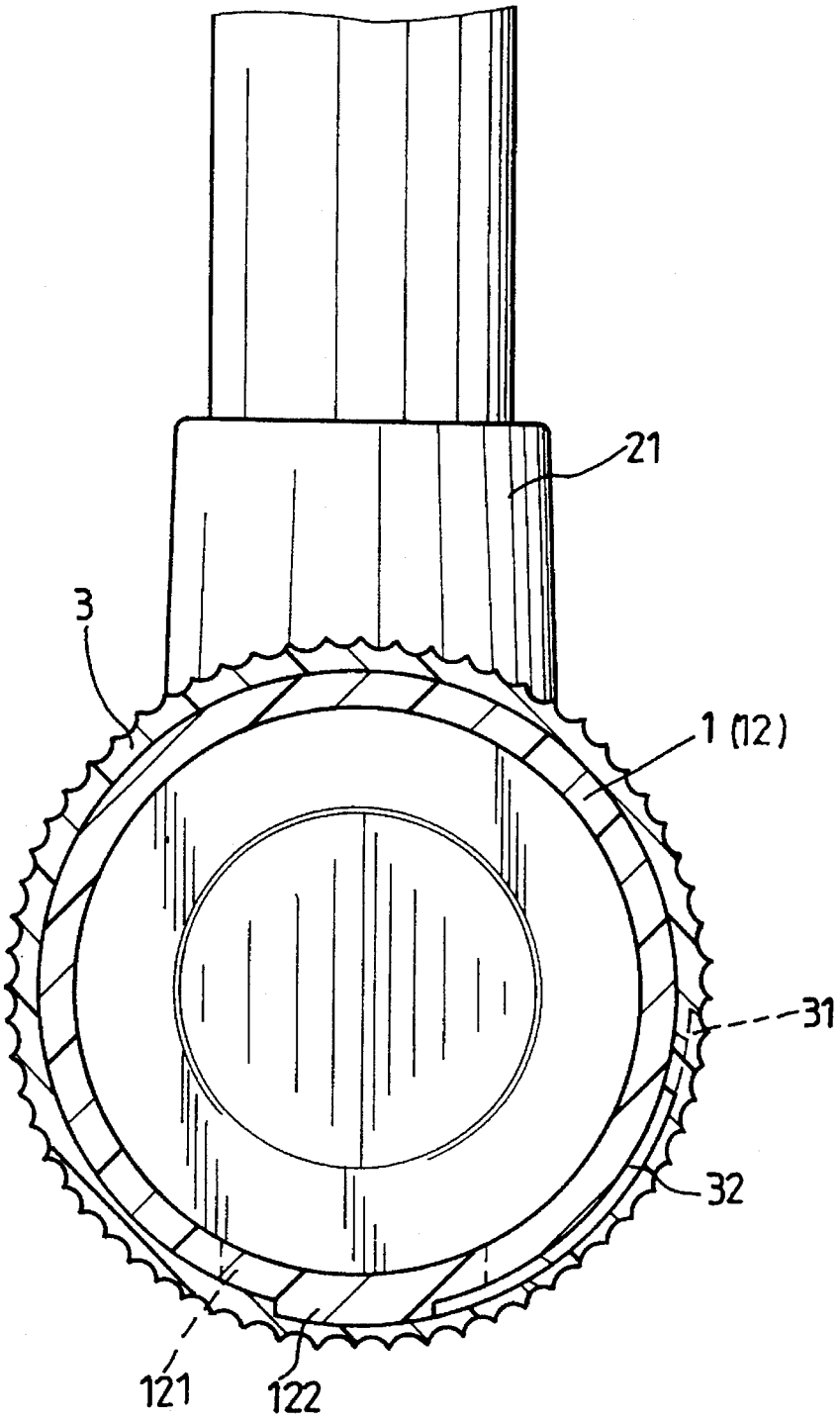
FIG. 3B is a view like FIG. 3A, but showing the opening of the circular ring being turned to depart from the key way of the lock core.
Figure 4:
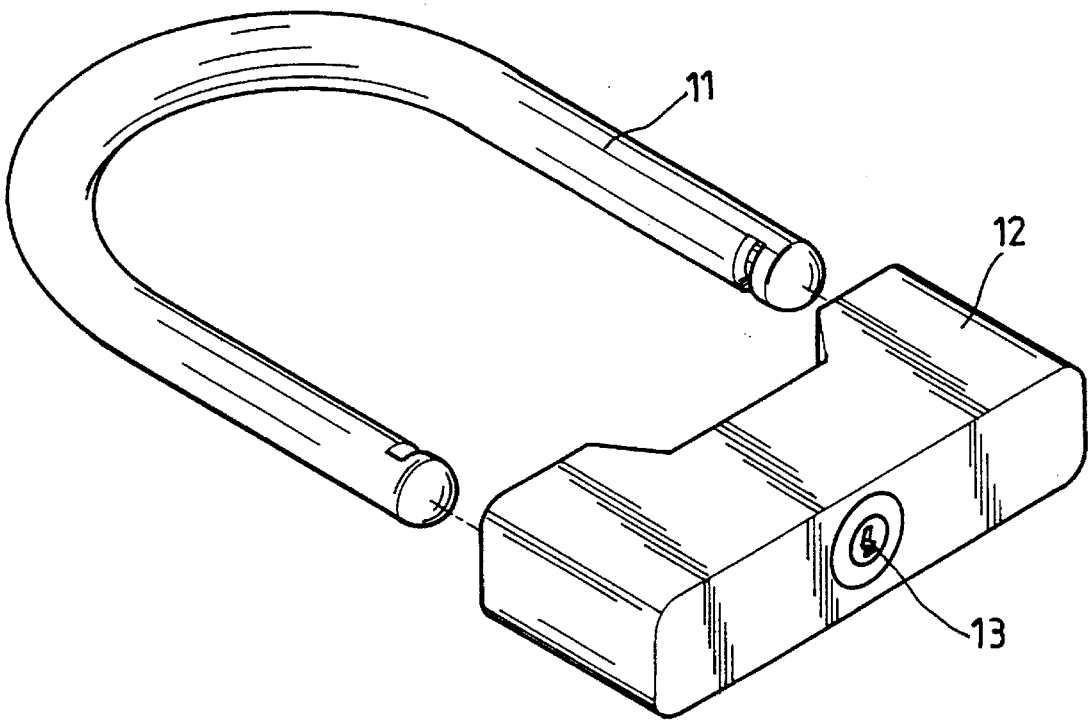
FIG. 4 (PRIOR ART)
FIG. 4 is a perspective view of a prior art lock.

When the circular ring 3 is turned to one direction, which is defined as the first direction, the aperture 31 aligns the key way 121 of the first lock housing 1, the key way 121 is exposed and a legal key may be inserted therein to unlock the lock, as shown in FIG. 3A. When the circular ring 3 is turned to an opposite direction, which is defined as the second direction, the aperture 31 is brought away from the key way 121 and the key way 121 is blocked by the circular ring 3 and no foreign objects, such as dust, can get into the key way, as shown in FIG. 3B.

I claim:

1. An improved lock housing for a lock assembly with a key way blocking means comprising a first lock housing, a second lock housing secured to said first lock housing, and a circular ring rotatably sleeved to one end of said first lock housing, the improvement comprising:

said first lock housing having a longitudinal passage along the axis, a boss extending upwardly and transversely therefrom, and a reduced outer diameter portion at one end defining a neck, said neck having a first flange at a conjunction area between said first lock housing and said neck, a notch at the endmost of said neck, and an aperture at one side of said neck;

said second lock housing being secured to said first lock housing for substantially enshrouding the lock assembly having a longitudinal passage along the axis, a boss extending upwardly and transversely therefrom, and a circular recess at one inner end of the periphery having a second flange extending from inside thereof corresponding both in shape and size to that of said notch of said first lock housing, said circular recess engagedly receiving said neck of said first lock housing to secure said first lock housing to said second lock housing;

said circular ring having an inner diameter slightly larger than the outer diameter of said neck, an aperture corresponding both in shape and size to that of said aperture of said first lock housing, and a groove at one side thereof being shaped and sized to receive said first flange of said first lock housing in a slidable manner, said circular ring being rotatably displaceable about said neck of said first lock housing for selectively blocking or exposing a key way of said lock housing.

* * * * *